United States Patent [19]

Kruyer

[11] 4,236,995

[45] Dec. 2, 1980

[54] PROCESS FOR RECOVERING BITUMEN FROM TAR SAND

[75] Inventor: Jan Kruyer, Edmonton, Canada

[73] Assignee: Kruyer Tar Sand Development, Inc., Salt Lake City, Utah

[21] Appl. No.: 37,897

[22] Filed: May 10, 1979

Related U.S. Application Data

[63] Continuation-in-part of Ser. No. 913,593, Jun. 8, 1978.

[30] Foreign Application Priority Data

Feb. 10, 1976 [CA] Canada ..... 245340

[51] Int. Cl.[3] ..... C10G 1/04

[52] U.S. Cl. ..... 208/11 LE

[58] Field of Search ..... 208/11 LE

[56] References Cited

FOREIGN PATENT DOCUMENTS

| | | | |
|---|---|---|---|
| 657877 | 2/1963 | Canada | 208/11 LE |
| 741302 | 8/1966 | Canada | 208/11 LE |
| 778347 | 2/1968 | Canada | 208/11 LE |
| 787898 | 6/1968 | Canada | 208/11 LE |
| 975700 | 10/1975 | Canada | 208/11 LE |

*Primary Examiner*—Herbert Levine
*Assistant Examiner*—Joseph A. Boska
*Attorney, Agent, or Firm*—Criddle & Western

[57] ABSTRACT

Oil sand is mixed with steam and water in a tumbler to produce a slurry. The slurry is then transferred to the immersed portion of an apertured inclined surface in a water bath. The inclined surface may be in the form of a rotating drum, a tilted rotating dish or an inclined moving endless conveyor belt. The sand particles drop through the apertures and are collected from the base of the bath and discarded. The bitumen moves to the submerged portion of the oleophilic inclined surface and attempts to pass through the apertures; it touches the surface and adheres thereto. The adhering bitumen is collected when the coated surface emerges from the slurry. The process gives a good recovery of a bitumen product which has acceptable quantities of solid and water contamination. The temperature of separation, the need for reagents, and water requirements are reduced in comparison to the prior art. The process can generally be used for separating oleophilic materials from hydrophilic materials.

35 Claims, 8 Drawing Figures

PROCESS FOR RECOVERING BITUMEN FROM TAR SAND

BACKGROUND OF THE INVENTION

This application is a continuation-in-part of Ser. No. 913,593 filed June 8, 1978.

This invention relates to a process for extracting bitumen from oil sand in particular and for separating oleophilic materials from hydrophilic materials in general. Oil sand is found in many parts of the world, in particular in Canada, the U.S.A., Venezuela, Malagasy, and the U.S.S.R.

Bitumen is presently commercially extracted from mined oil sands using a hot water process. In accordance with this process, the oil sand is first mixed with hot water, sodium hydroxide and steam in a rotating horizontal tumbler, called a conditioning drum. In this operation, the components of the oil sand (i.e. bitumen, water and solids) are dispersed by a combination of heating and dilution with water. More particularly, the heated oil sand comprises water-wet grains having oil trapped therebetween. As water is added, the water phase swells and the sand grains collect therein; the bitumen separates from the grains and forms discrete flecks.

The slurry formed in the conditioning drum is then diluted with additional water and introduced into a separation vessel. This vessel has a cylindrical body and a conical bottom. Here the coarse sand grains drop to the bottom of the vessel and are removed through an outlet as a tailings stream. This stream is discarded into a pond system. The bitumen flecks, which are slightly less dense than water because of the high process temperature, attach themselves to gas bubbles entrained in the slurry, rise through the vessel contents and form a froth product. This product overflows the vessel wall into a launder and is collected. The fine solids remain largely suspended in the water of the separation vessel.

There are several problems of interest in the existing process. Firstly, there are difficulties connected with the bitumen flotation operation going on in the separation vessel. More particularly, if a large concentration of solids is present in the contents of the separation vessel, these solids will impede the upward progress of the aerated bitumen. Therefore, in order for the aerated bitumen to rise quickly through the vessel contents, it is desirable to have a dilute system within the vessel. This means that a relatively large amount of water must therefore be used in the process. Since this water must be heated to about 190° F., the energy requirements of the process are therefore increased as the water content is increased. Because large amounts of water are introduced into the process, it is necessary to withdraw a middlings dragstream from the midpoint of the vessel to maintain a balance. This middlings dragstream is treated in a sub-aerated flotation cell, to recover contained bitumen, and is then discarded into the pond system. Unfortunately, fine solids (−325 Mesh) associated with the oil sand pass through the process and end up in the tailings water in the pond system. The presence of monovalent alkaline reagents, such as sodium hydroxide in the tailings water from the process causes the clay particles to settle extremely slowly and therefore the water must be held for prolonged periods of time before it is low enough in solids to be reused in the process. This then requires that inordinately large tailings ponds be provided. In summary, the flotation mechanism in the prior art process requires that large amounts of heated water be used and that solids removal in the ponds be extensive, thereby necessitating an extensive pond system.

BRIEF DESCRIPTION OF THE INVENTION

With this background in mind, it is an object of the present invention to separate bitumen from oil sand using a process which gets away from the flotation mechanism of the prior art, which can tolerate relatively higher levels of solids in the plant water, and which does not require the use of monovalent alkaline reagents.

In accordance with the general concept of the invention, oil sand is mixed with water and usually steam to form a slurry and remove the oil phase from between the sand grains by a combination of tumbling, heating, and dilution with water. The slurry product is then temporarily contained or supported by the immersed portion of an oleophilic sieve-like member in a water bath. Most of the slurry solids drop through the apertures of the sieve-like member, while most of the bitumen adheres to its surface as it comes in contact therewith. The coated section of the sieve-like member then rotates or moves out of the slurry and the bitumen is recovered therefrom.

In one embodiment of the invention, oil sand is first conditioned in a rotating tumbler with hot water, and steam to produce a slurry by the combined action of tumbling and heating in the presence of water. This slurry is then transferred to an apertured or perforated horizontal drum having an oleophilic inner surface rotating within a water bath. Here the sand drops through the apertures while the bitumen adhers to the oleophilic inner surface of the drum. When the bitumen-coated section of drum wall rotates out of the slurry and water bath, the bitumen is collected from this wall.

In a more practical and preferred embodiment of the invention the slurry produced by the rotating tumbler is transferred to the immersed portion of the top flight of an inclined, apertured, oleophilic endless conveyor belt in a water bath. The sand drops through the apertures of both belt flights while the bitumen coming in contact with the oleophilic belt surfaces adheres thereto. Bitumen is collected after the coated flight section of the running conveyor emerges from the water bath.

It has been found that a comparatively good bitumen recovery can be achieved in this manner. The bitumen product is low in solids and water content. The process is capable of tolerating a higher solids content in the plant water used than the prior art.

DETAILED DESCRIPTION OF THE INVENTION

In the present invention bitumen is defined as any hydrocarbon oil, crude or refined, that is mixed with mineral materials and/or water. Oil sand or tar sand in the present invention is defined as any mixture of hydrocarbon oil and mineral, with or without water, that is provided in the form of a slurry or that can be formed into a slurry by steam jetting and mixing with water in a rotating tumbler. Many mixtures of oil, water and minerals fall under these definitions. Without limiting the scope of said definitions, examples of mixtures that may be separated by the present invention are:

1. Slurries of bitumen, water and mineral particles, produced by mixing oil sand with water and steam in a conditioning drum.

2. Slurries of bitumen, water and mineral particles, produced by mixing oil sand with water and steam in a conditioning drum followed by a sand reduction step for the purpose of removing some of the mineral particles from the slurry prior to separation.

3. Mixtures of oil, water and minerals found in various streams in a plant using the Hot Water Process. These include the middlings drag stream from the separation vessel, the various tailings streams from the process, the bituminous froth product from the separation vessel, the bituminous froth product from the sub-aerated flotation cells and the sludges of water, bitumen and fine mineral particles found in the pond system.

4. Mixtures of oil, water and mineral particles brought up to the earth's surface from oil wells.

5. Mixtures of water, oil and beach sand that result as a consequence when an oil tanker spills crude or refined oil at sea that washes up on a beach.

6. Mixtures, consisting of water-in-oil emulsion and water, containing small amounts of minerals.

7. Mixtures, of liquid or semi-liquid hydrocarbons and water in which each is not miscible in the other in large proportions, with or without particulate solids.

CONDITIONING

In the first step of the preferred process, oil sand, steam and water and in some cases bitumen, are introduced into a conditioning drum 1 in amounts such that a slurry is produced containing sufficient water to provide a fluid consistency that will allow adequate mixing inside the conditioning drum, having a mean temperature such that the bitumen phase reaches a viscosity of more than one poise but of not exceeding a thousand poises. Typically for mined Alberta oil sands the temperature in the conditioning drum is about 130° F. but it can be higher or lower, depending upon the desired time interval to produce a slurry from the oil sand feed stock used. Higher conditioning temperatures will reduce this time interval and permit the use of smaller conditioning drums for the same feed rate. Due to the variability of the Alberta oil sand feed stocks found within the deposit, the actual amount of water required varies also. However, a slurry containing 0.1 to 1 pound of water per pound of oil sand is acceptable for most feed stocks.

Figure 1:
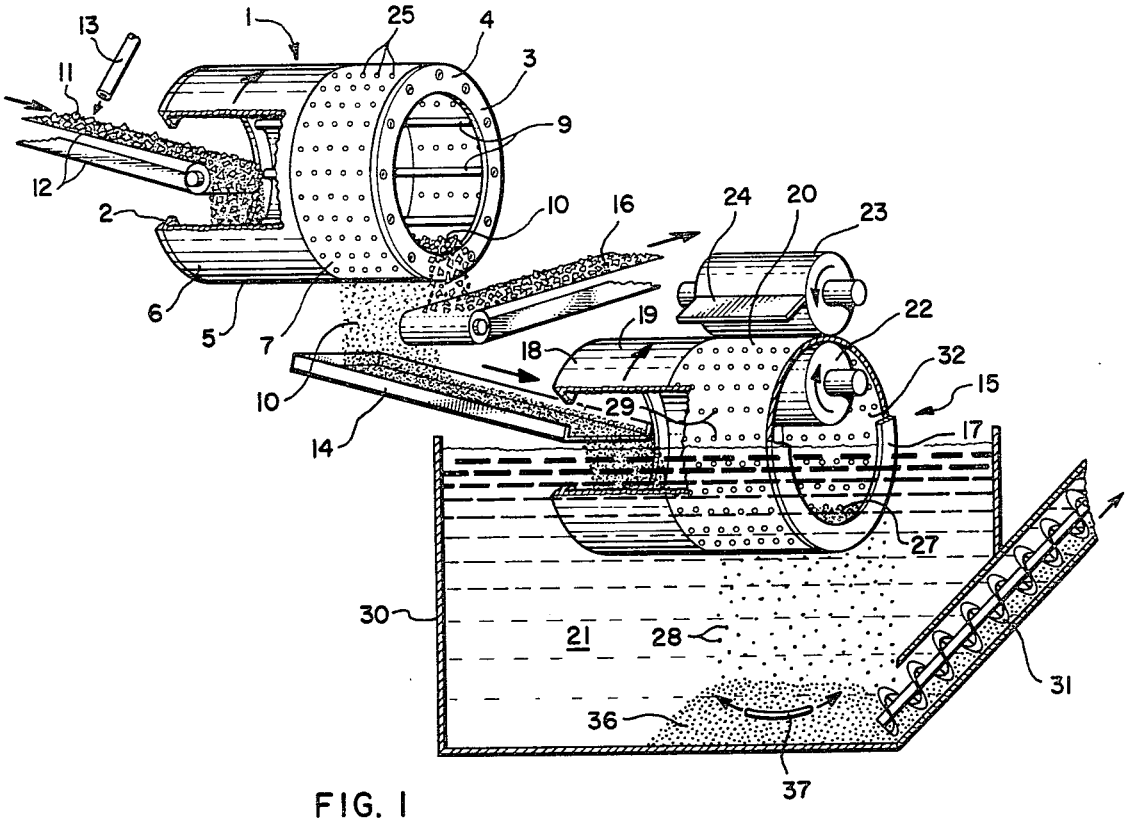
FIG. 1 is a perspective view showing the tumbler, separating sieve type drum, bitumen recovery assembly and water bath of one form of the invention.

With reference to FIG. 1, the drum 1 is a horizontal rotating cylinder having a rear and front ends 2, 3, each partially closed by a washer 4. The cylindrical side wall 5 of the drum has a solid rear portion 6 and a perforated or apertured front portion 7.

Steam, if desired, is introduced into the interior of the drum 1 through a distributor valve (not shown), which feeds it to a series of perforated pipes. These pipes 9 extend longitudinally along the interior surface of the drum in spaced relationship about its circumference. The valve feeds the steam to the pipes 9 only when they are submerged within the slurry 10. The oil sand 11 is fed into the rear end of the drum 1 by way of a conveyor 12. Water is added to the oil sand at the rear end of the drum through pipe 13. The ingredients mix in the drum and form a smooth slurry 10. This slurry 10 drops through the apertures 25 of the apertured drum portion 7 into a channel 14 which carries it to the separation drum 15 or separation dish or separation belt. Rocks and other oversize material leave through the front of the drum 3 and drop onto a conveyor belt 16 which carries them to a discard area.

In the drum 1, the oil sand is formed into a slurry in which the water is in intimate contact with the hydrophilic particles of the slurry and the bitumen agglomerates into globules or streamers that contain the oleophilic particles of the slurry.

Alternately, in a conditioning drum 1, medium or rich oil sand is formed into a slurry by jetting the oil sand with steam in the presence of water such that the water becomes in intimate contact with the sand grains of the slurry and the bitumen agglomerates into globules or streamers.

SEPARATION

The slurry thus produced can be separated by an inclined apertured oleophilic endless belt, an apertured oleophilic drum or by a tilted apertured oleophilic dish. The mechanism of separation in these three embodiments of the invention does not differ greatly except where noted in the disclosure. The embodiment of the invention that uses a slurry of mined Alberta oil sands in an oleophilic separation drum is described next in detail for the purpose of explaining the separation mechanism.

The slurry 10 is transferred by the channel 14 into the rear of the separation drum 15 of FIG. 1. This unit is cylindrical, having ends partially closed by washers 17. The rear portion 18 of the drum side wall 19 is closed while the front portion 20 is apertured. The separation drum 15 is suspended in a heated water bath 21 by one or more transfer rollers 22, so that the drum is immersed up to or past its center line. A driven oleophilic collector roller 23 is mounted on the outside of the drum 15 in a particular position relative to the transfer roller 22. A doctor blade 24 presses against the collector rollers 23 to scrape off accumulated bitumen.

In operation, the slurry 10 from the conditioning drum 1 spills into the separation drum 15 and is contained there as a dilute slurry 27 while the solids and bitumen separate in a fluid environment. The solid particles 28 drop through the slurry 27 and pass through the apertures 29, falling to the bottom of the bath 21. As shown in FIG. 1, the heated water bath 21 is contained in an outer vessel 30. An auger 31 is provided to draw the separated sand out of the base of said vessel. The bitumen moves through the slurry 27 contacts, and adheres to the submerged portions of inner oleophilic surface 32 of the drum 15. When the drum's cylindrical side wall 19 rotates out of the water bath 21, the transfer roller 22 forces this bitumen through the perforations or apertures 29. The oleophilic collector roller 23 immediately picks up the bitumen pressed through the perforations 29 and together the collector roller 23 and the transfer roller 22 clear the perforations, so that they are again available to permit the passage of solids therethrough. A doctor blade 24 removes the bitumen from the collector roller. Only one transfer roller and one collector roller are shown. In practice at least two of each are used to more effectively remove the bitumen out of the apertures.

It is desirable to maximize the affinity of the drum's inner surface 32 for bitumen. This can be accomplished by coating the steel surface with tin, polyolefin, neoprene, urethane elastomer or any other oleophilic, abrasion resistant and bitumen resistant coating.

The uncoated steel surface of the apertured drum is somewhat oleophilic and attracts bitumen but on applying a more oleophilic coating, such as just described, to the surface 32, it was found that the bitumen would more readily adhere thereto and the rate of recovery and the quality of the bitumen and sand products improved.

The drum cylindrical side wall 19 is perforated, preferably with perforations 29 having a diameter within the range of 0.5 to 0.50 inches, most preferably about 0.25 inches. It has been found that the sand passes through the perforations 29 with increasing difficulty as their diameter dimishes below about 0.05 inches. There is a build up of solids within the drum 15 when this is the case. Conversely, the bitumen begins to pass through the perforations 29 with increasing ease as the perforation diameter exceeds about 0.50 inches, thereby reducing the bitumen recovery. The size of the perforations is influenced to some degree by the type of slurry being separated. The above sizes are optimum for medium to high grade Alberta oil sand slurries.

The reason why the rear portion 18 of the drum side wall 19 is not perforated is to give the slurry 10 spilling into it from the conditioning drum 1 a chance to dilute with water and to reach the separating temperature before contacting the perforated surface 20. In some cases this provides for an improved separation. However, good separation has also been achieved with a drum with a side wall perforated over its entire surface.

The temperature of the slurry undergoing separation within the drum should be such as to provide an as-recovered-bitumen viscosity in the range between 0.1 and 10,000 poises, preferably between 3 and 3000 poises and most preferably between 10 and 1000 poises. With Alberta oil sands the preferred temperature was found to be between 85° F. and 140° F., most preferably about 130° F. The rate of separation diminished, and a build-up of solids within the drum 15 commenced when the temperature of separation of Alberta oil sands slurries dropped below 85° F. The weight of accumulated solids in the drum 15 then pushed unseparated slurry through the perforations and as a result the collected bitumen contained higher percentages of minerals and the sand at the bottom of the water bath contained higher percentages of bitumen. When the temperature exceeded 140° F. by about 20° F., i.e. 160° F., the bitumen layer on the oleophilic drum surface became very thin and bitumen did not accumulate there in large quantities but migrated in significant amounts through the perforations and was lost with the sand or floated on the surface of the water bath. These are the preferred temperatures for separating bitumen from Alberta oil sands. However, higher temperatures in the range of 141° to 212° F. are required for separating the more viscous bitumen from Utah tar sands, while separation temperatures as low as 32° F. are sufficient to remove conventional crude oil from beach sand to clean up the results of oil washed on to a beach from an oil spill at sea, for example. The optimum separation temperature range therefore varies with the slurry to be separated and the system chosen for the separation. However these ranges will generally be between about 32° and 212° F.

The slurry undergoing separation should contain at least one half pound of water per pound of sand. If the slurry is thicker, the mobility of the bitumen globules or streamers is hindered by the sand particles of the slurry, less of the bitumen in the slurry contacts the oleophilic apertured wall 32, and bitumen losses are greater with the sand that leaves the drum 15 through the perforations. It does not appear to matter how much more dilute the slurry is, however, it is self-evident that the process will be run with the minimum amount of water consistent with good bitumen recovery and quality. In practice, the outside vessel 30, which holds the water bath 21, is initially full of water which more than half fills the separation drum 15 and this water or slurry level is maintained throughout each test. It has been the case that the units, as so started and with the composition of slurries fed to them, have consistently had a water content above the mentioned lower limit. However, in a continuous operation it may be necessary to establish a minimum consistency for the system involved and perhaps add additional water. Any excess water will have to be drawn off, cleaned by removing some of the suspended solids and then may be reused in the conditioning drum.

It is necessary to provide means for collecting the adhering bitumen from the drum's surfaces, in particular from the inside surface 32 and out of the perforations 29. This may be done by forcing the bitumen through the perforations 29 after it has rotated out of the water bath with an inside transfer roller 22 and then collecting it with an outside recovery roller 23. The bitumen on the recovery roller 23 can be scraped therefrom with a doctor blade 24. Scraping the drum outside surface directly with a doctor blade will remove bitumen from that surface, but it will tend to abrade or wear this surface 33 and has been found to be not as effective as using a recovery roller for removing bitumen out of the perforations 29.

It has been found that the rollers 22 and 23 can suitably be formed of neoprene, urethane, or any other resilient, oleophilic, bitumen resistant material. The collector roller 23 only works if its surface is oleophilic but the transfer roller 22 may be either oleophilic or hydrophilic (oleophobic). If the transfer roller is oleophobic, it will effectively push the bitumen through the perforations without leaving much residual bitumen on its own surface but it will not aid the outer roller in opening up the perforations by removing the bitumen out of them. Open perforations are needed to allow subsequent sand passage. If the transfer roller is oleophilic, it pushes the bitumen through the perforations but subsequently withdraws some of the bitumen out of the perforations, keeping its surface covered with mounds of bitumen but aiding the outer roller in cleaning out the perforations.

If the surface of the transfer roller is oleophilic, it may be scraped with a doctor blade, (not shown) after it has pushed bitumen through the perforations, to remove the remaining bitumen mounds from its surface. This increases somewhat the rate of bitumen recovery and hence the separation by providing a second stream of bitumen and by reducing the amount of bitumen pushed through the perforations.

Figure 5:
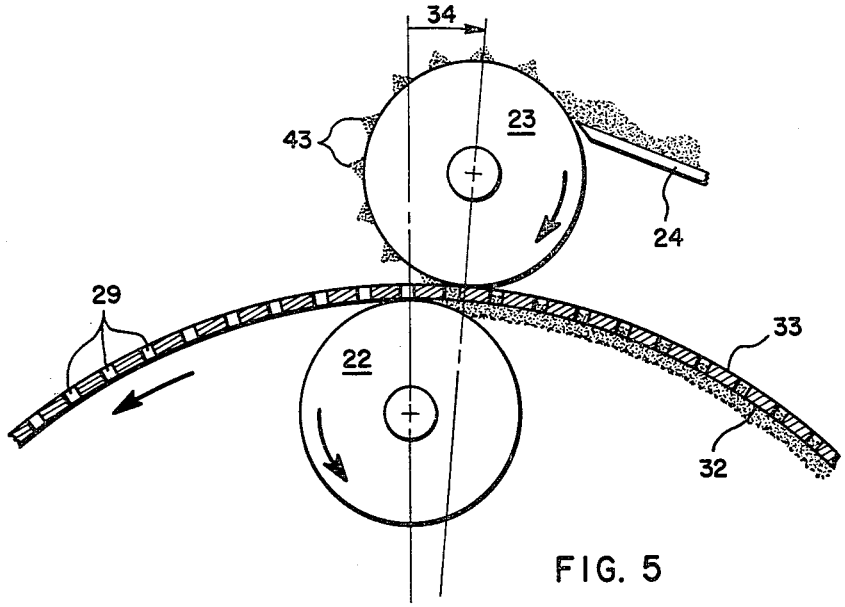
FIG. 5 is a schematic illustration of a method for recovering bitumen from the sieve using two offset rollers.
Figure 6:
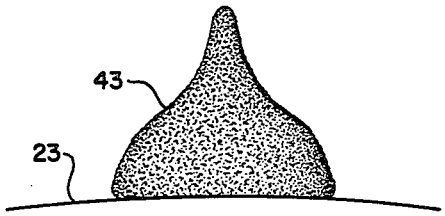
FIG. 6 is an illustration of bitumen mounds as they are produced on the recovery roller if the rollers are in the preferred offset position.
Figure 7:
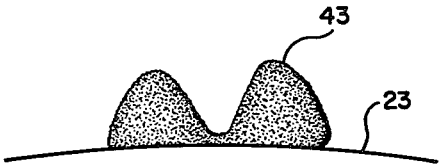
FIG. 7 is an illustration of bitumen mounds as they are produced on the recovery roller as the rollers are positioned with an improper offset distance.

As shown in FIG. 5, the transfer roller 22 is slightly offset from the collector roller 23 in the direction of the drum surface movement which may be defined by a positive angle of offset between the centers of the rollers relative to the center of the drum. As the separation drum 15 rotates counterclockwise, the transfer roller 22 forces the bitumen collected on the drum's inside surface 32 through the perforations 29. If the angle of offset is correctly chosen, the extruded bitumen forms mounds 43 on the collector roller 23 having a shape as shown in FIG. 6. If the angle of offset 34 is too small, the bitumen smears on the rollers 22, 23 and the surfaces 32, 33 and collection by the roller 23 is relatively poor. If the angle of offset is too large, mounds 43 are produced that have a configuration as shown in FIG. 7. It has been found that collection onto the roller 23 deteriorates in this circumstance.

Transfer of bitumen to the collector roller 23 may be enhanced if the drum's outside surface 33 is less oleophilic than the surface of the collector roller 23, since the bitumen being forced through the perforations 29 will not tend to linger on the outside drum surface 33 but will directly transfer to the oleophilic roller 23.

The optimum rate of rotation of the separation drum 15 will have to be determined for each system. However, it has been found that if the rate of rotation is too fast, additional water is picked up by the bitumen layer on the drum surface 32, making it less oleophilic and thereby reducing adherence of bitumen from the slurry onto the drum surface 32. As a result, the efficiency and the rate of separation of the unit decreases. Generally the surface speeds of the drum will vary from about 0.1 to 10.0 ft/sec.

It has been found that bitumen recovery can be enhanced by driving the recovery roller 23 at a surface speed slightly faster, i.e. 1 to 10%, than the surface speed of the apertured wall and of the transfer roller 22. However, in practice it is expected that this will result in undesirable abrasion of the apertured wall surface 33 and of the surface of the recovery roller 23 unless this excess surface speed is very small.

Figure 4:
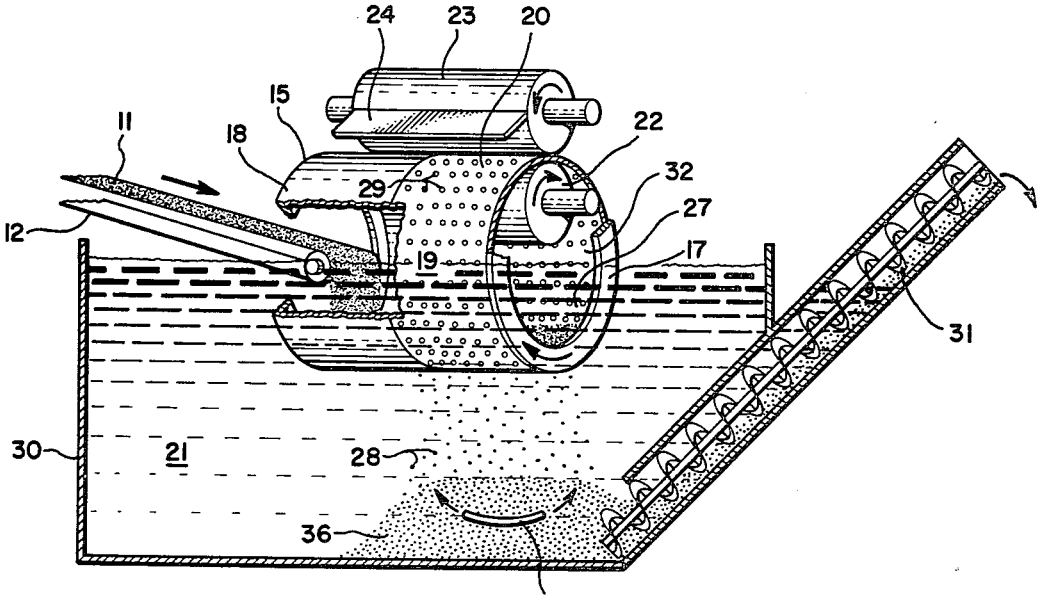
FIG. 4 is a perspective view of another version of the system, showing a drum, perforated along part of its length, being used both to prepare the slurry and as a sieve to separate the oil phase from the hydrophilic solids.

A modification of FIG. 1 is shown in FIG. 4. The conditioning drum is eliminated and the oil sand is fed directly into separation drum 15. In all other respects the operation is the same.

Figure 2:
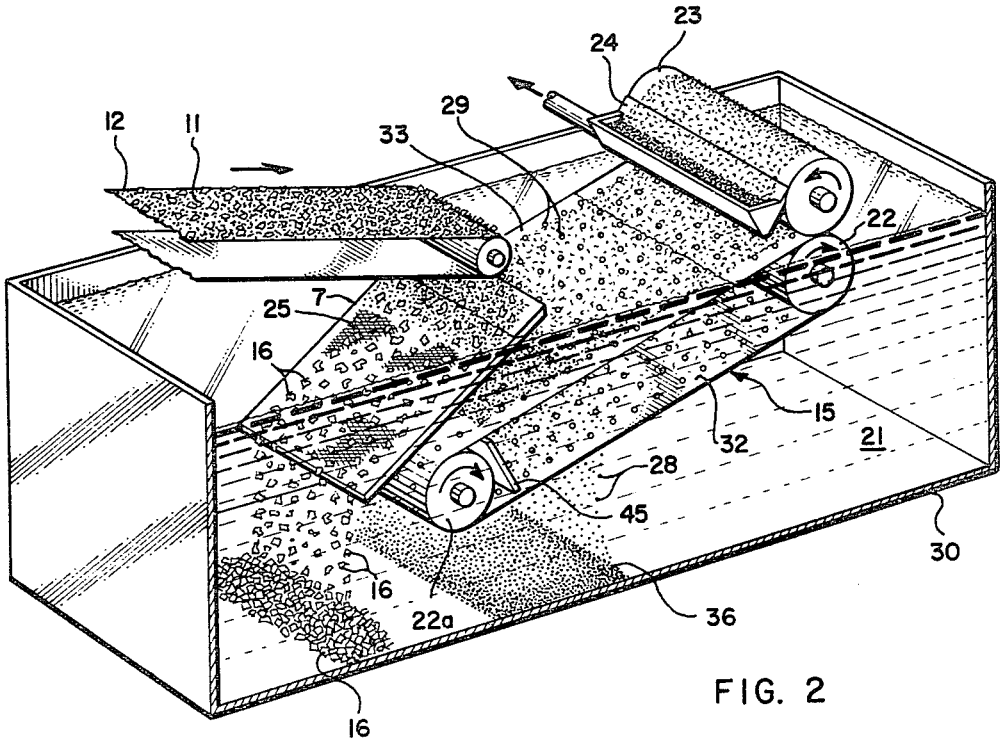
FIG. 2 is a perspective view of the preferred form of the sieve in the form of an apertured conveyor belt, inclined and partly immersed in a water bath, being used as a separator, with rollers and a doctor blade assembly for recovering the adhering bitumen.
Figure 3:
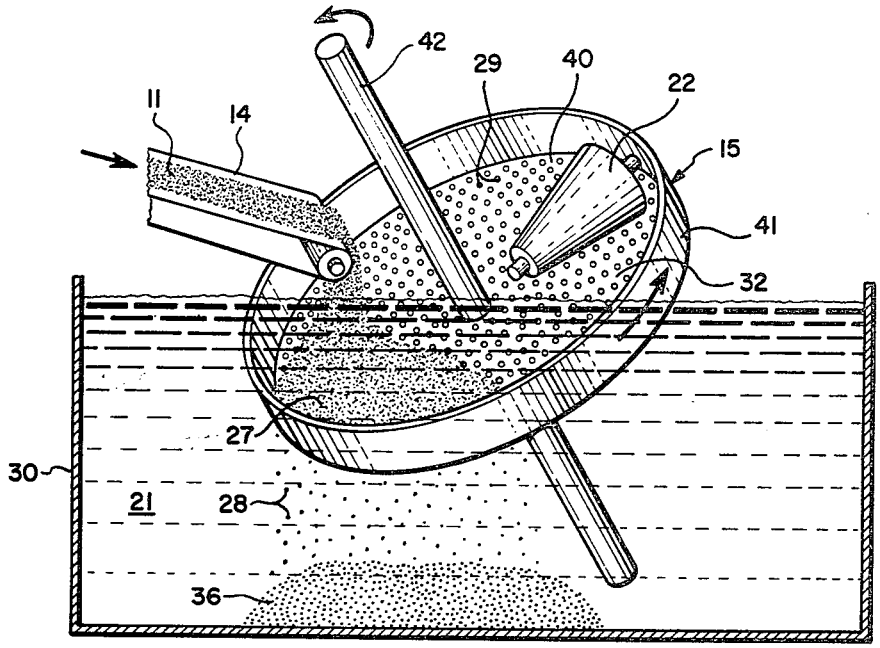
FIG. 3 is a perspective view of an alternative embodiment of the sieve, showing an apertured dish, with sides, partly immersed in a water bath, functioning as the sieve separator, with a transfer roller being used to transfer bitumen adhering to the dish's inner surface through the apertures onto a recovery roller (not shown) behind the dish.

Alternate apparatus for carrying out the process according to the invention are shown in FIGS. 2, 3 and 4. The numbers on these Figures relate to parts having the same function as corresponding numbers in FIG. 1.

FIG. 2 illustrates an embodiment of the invention using an apertured conveyor belt in place of an apertured drum for the separation. A conveyor belt has an advantage over the drum that becomes apparent when the invention is scaled up to the sizes necessary for commercial operation. This is because the structural integrity of an endless belt, stretched between conveyor end-rolls is based upon the tension that can be sustained by the belt while, in contrast, the structural integrity of the drum is based upon the resistance to bending of the apertured side wall. Separating equipment for oil sands is normally built very large because of the desired large commercial feed rates, and when drums are to be used for the separation these by necessity must be of large diameter also. In order to provide for structurally sound and lasting large scale equipment design, it will be necessary to use thick apertured side walls for large diameter drum separators. Proper functioning of the invention, however, is dependent upon the ability of the transfer and recovery rollers to remove sufficient bitumen out of the apertures to reopen them for subsequent sieving of the hydrophilic solids from the slurry. Increasing the aperture diameter directly with the thickness of the apertured wall would permit removal of bitumen out of the apertures. Scaling up the equipment in this manner, however, reduces the efficiency of the invention because large apertures allow the passage of slurry through the apertured wall without effectively removing the bitumen from this slurry. When that happens, the sand at the bottom of the water bath will contain a higher percentage of bitumen than desired. Consequently, for an oleophilic apertured wall separator there will be a limiting size beyond which the invention will cease to work effectively. The limiting size can be increased somewhat by making the wall surface in contact with the recovery roller oleophobic and by making the aperture walls partly oleophobic. When this is done, these oleophobic surfaces will more readily release the bitumen out of the apertures. The limiting size can be increased further by using a mesh wall instead of a perforated wall for the separation. The woven construction of a mesh wall, and the varying size of a typical aperture through the wall, permit for a more ready deformation of the surfaces of the transfer and recovery rollers so that these can dig deeper to remove bitumen out of the apertures. For all practical purposes, however, the thickness of the apertured wall should not exceed more than three aperture diameters, based upon the average diameter of the apertures through which the majority of the hydrophilic solids pass. It has further been found that, for a given type of aperture, the separation efficiency and rate are improved as the thickness of the apertured wall is decreased. Generally the thinnest wall gives the best efficiency; provided that reducing the wall thickness is consistent with proper design practice and does not adversely affect the oleophilic nature of its surface. Structurally sound conveyors can readily be made with the use of very thin perforated sheet of high tensile strength, or with the use of very thin mesh belts that are woven from high tensile strength strands that are oleophilic or that can be covered with an oleophilic coating. In contrast, proper design practice cells for a much thicker apertured wall to provide structural integrity to a drum. For that reason the oleophilic apertured endless belt has an advantage over the oleophilic apertured drum for use as a separator.

The use of a mesh belt has the added advantage that for a given belt thickness and strength a mesh sieve is more efficient than a perforated sieve for passing hydrophilic mineral particles. This is because of its larger open area and because of the nature of its surfaces. For a given separation rate, the mesh wall does not seem to be inferior to the perforated wall for recovering bitumen from the slurry.

Both the top flight and the bottom flight can be used when an endless belt is used for the separation, such that the slurry passes through the apertures of the top flight first and then through the apertures of the bottom flight next. Such a two stage process has the advantage that bitumen is removed from the slurry at each flight in succession. For a given feed rate this results in a tailings product from which more bitumen has been removed, or conversly, for the same tailings product quality it permits a faster feed rate for separation.

FIG. 2 illustrates one form of apertured belt separator. An oil sand slurry 11 produced in a conditioning drum is fed from the drum to a conveyor 12 and enters water bath 21 directly over a sieve or screen 7 having apertures 25 about the same size or slightly smaller than the apertures 29 in the separation belt 15. The oversize material 16 is unable to pass through the screen 7 and falls to the bottom of the water bath for removal by an auger or other conveyor means. In normal practice this screen is cylindrical and forms part of the conditioning drum. It is illustrated, however, in FIG. 2 as a flat screen through which the slurry has to pass prior to separation to emphasize the need for pre-screening of the slurry to assure that the solid particles in the slurry do not exceed the aperture size of the endless belt. Any oversize particles would not pass through the apertures and would seriously hinder the operation of the separator. The oil sand slurry passing through the screen 7 falls onto the oleophilic surface 33 of the separation belt 15. Some of the bitumen adheres to the oleophilic surface 33 of the belt 15. The sand and remaining bitumen passes through the apertures 29 in the top flight of the separation belt 15 and falls on the oleophilic surface 32 of the bottom flight. The remaining bitumen adheres to said surface 32 and clean sand 28 falls through the lower flight apertures 29 to form a bed 36 on the bottom of a water bath from which it can be removed and returned to the environment by means of an auger, conveyor belt, pipeline, or by mechanical rakes. The separation belt 15 is constructed and operated such that the sand particles pass through the apertures 29 and do not fall over the sides of the belt. A baffle 45 prevents the sand passing through the top flight of the separation belt from coming in contact with the submerged transfer roller 22*a*. In this illustration the transfer roller is one of the conveyor end rolls. In actual practice it is more convenient to mount a transfer roller and a recovery roller along the belt surface prior to the conveyor end roll so that this end roll does not have to do double duty but can serve to keep the conveyor central on the rollers.

In FIG. 2 the bitumen adhering to the submerged oleophilic surfaces of the separation belt 15 revolves out of the water bath 21 and is forced up through apertures 29 by transfer rollers 22 and 22*a*. The bitumen is picked up from the surface and perforations of the separation belt 15 by the collector roller 23. Preferably the surface of collector roller 23 is strongly oleophilic. A doctor blade 24 removes the bitumen from the driven collector roller 23 preparatory to the collector roller picking up additional bitumen.

A particulr advantage of this method is that bituminous products having a specific gravity lighter than water will adhere to the olephilic separation belt 15 as it rotates out of the water. Thus bitumen may be removed from water surfaces as well as from sands using this invention.

Generally the same operating conditions of temperature, bitumen viscosity and slurry dilution that apply to a drum separator also apply to a belt separator.

FIG. 5 illustrates the use of a transfer roller 22 that pushes bitumen from the inside surface 32 of an apertured drum through the apertures 29 onto the surface of a recovery roller 23 from where it is removed with a scraper 24. The same principle is used for recovering bitumen from an apertured belt. In that instance, the surfaces 32 and 33 are not curved but are linear from the right of the Figure to the point of contact with the recovery roller 23 and they are also linear from the point of contact with the transfer roller 22 to the left of the Figure. Normally there are minor inflections in the belt surfaces 32 and 33 at the points where the rollers contact these surfaces. These inflections in the belt are caused by the pressure imposed upon the belt by the two rollers in order to achieve effective bitumen transfer and recovery. When a belt is used the bitumen may be adhering either to the surface 32 in contact with the transfer roller 22 or to the surface 33 in contact with the recovery roller 23, or both. When it adheres to the surface in contact with the transfer roller, then the bitumen is pushed directly through the apertures onto the recovery roller. When the bitumen adheres to the belt surface in contact with the recovery roller, then the recovery roller first pushes it through the apertures towards the transfer roller and then the transfer roller pushes it again through the apertures onto the recovery roller. It is obvious that for the purpose of recovering bitumen it would be advantageous, where the design permits this, to only push the bitumen through the apertures once.

The distance of offset between the recovery roller and the transfer roller along the endless belt can be adjusted by fixing one of the two rollers and by moving the position of the other one along the belt until the optimum distance is reached. An alternate practical method that has been found effective is to select an offset distance that is slightly in excess of the optimum distance and mounting the roller shafts so that this distance along the belt can not be changed. Then, either the recovery roller or the transfer roller is adjusted in the direction perpendicular to the belt surface until optimum transfer and recovery of bitumen from the belt is achieved.

Figure 8:
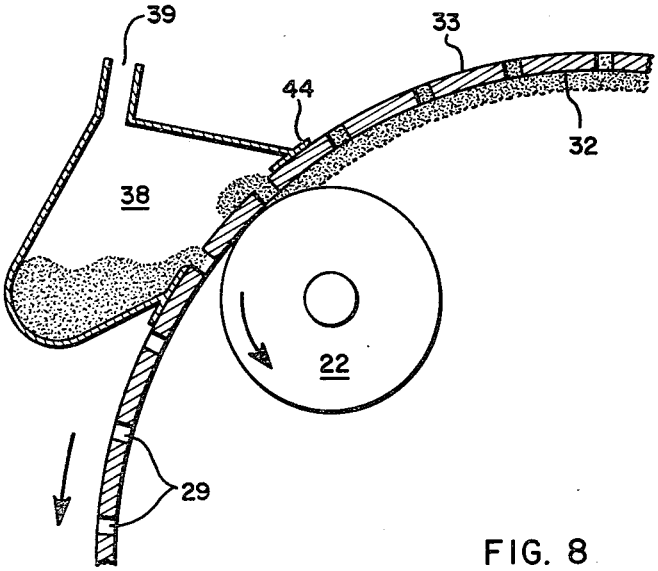
FIG. 8 is a schematic illustration of a method for recovering bitumen from the sieve using a vacuum chamber.

An alternate method of collecting bitumen from the oleophilic apertured surface 32 involves the use of a vacuum chamber unit 38, as illustrated in FIG. 8. The unit 38, connected to a vacuum line 39 and provided with boot like edges 44 to help seal in the vacuum, is held stationary and close to the moving surface 33. Bitumen collected on the apertured oleophilic surface 32 is sucked through the drum perforations 29 and collects in the vacuum unit 38, from where it is subsequently removed. Providing a bitumen transfer roller 22 or a source of compressed air at an elevated temperature on the drum's inside surface 32 can aid in pushing the bitumen into the perforations, from where it can be removed by the vacuum. Jets of steam, jets of hot water, or jets of petroleum diluent can be used to wash bitumen off the apertured surface to be recovered subsequently by the vacuum chamber 38 especially when the apertured wall is in the form of a mesh surface. Recovery of bitumen from both sides of the mesh surface can be achieved with such a recovery method.

FIG. 3 illustrates a third type of apparatus consisting of a dish 15 having a perforated bottom 40 with sides 41 rotating about a center shaft 42 which is angled such that the apertured floor is partially submerged in a water bath 21. Both upper surface 32 and lower surface (not shown) of floor 40 are oleophilic. The apertures 29 in floor 40 allow the processed sand 28 to pass through, forming a sand bed 36 at the bottom of container 30. In operation, oil sand 11 from conveyor 14 falls into water bath 21 onto the submerged portion of perforated floor 40 to form slurry 27. The bitumen adheres to oleophilic surface 32 and the sand particles 28 fall through perforations 29. As the floor rotates out of the water, transfer roller 22 forces the bitumen through apertures 29 to the lower side of floor 40. A collector roller and doctor blade (not shown) remove bitumen in the manner heretofore described.

In another feature of the invention, the sand or mineral bed 36 at the base of the bath vessel 30 may be aerated or stirred with an oleophilic rod or paddle 37. It is found that some bitumen that has passed through the apertures or has fallen off the apertured surfaces and has become entrapped in the bed 36 will rise and adhere to the apertured wall or will be caught by the paddle from where it can be removed. In this manner undesirable bitumen losses with the sand can be reduced.

Control of the pH of the slurry under separation is advantageous. When the pH of the slurry exceeds 8.0 it has been found that a portion of the bitumen phase forms very stable emulsions with water, mineral fines and sodium hydroxide reagent, that is very difficult to break. These emulsions largely remain in the water phase and eventually end up with the tailings of the process that are discarded. These emulsions undesirably increase the water content of the bitumen product when part of these emulsions are collected with the bitumen. In both cases these emulsions adversely effect the efficiency of separation. It has been found that separation of Alberta oil sands is much less effective when the pH drops below 5.0. Alberta oil sands generally occur in nature at a pH of about 7 and separation of mined Alberta oil sands by the instant invention have been achieved without the addition of pH controllers.

Thus the instant invention generally is for separating, in a water bath, a bitumen phase from a slurry containing hydrophilic solids and oleophilic materials, and specifically for separating bitumen from a warm oil sand slurry produced from Canadian oil sands. For the purpose of the separation, the slurry is contacted with an oleophilic sieve in a sieving stage such that water and hydrophilic solids pass the apertures of the sieve and bitumen adheres to the sieve. The sieve is then removed from the water bath for the purpose of a bitumen recovery stage in which bitumen phase is recovered from the sieve and out of the apertures that had become filled with bitumen during the sieving stage. The sieve is then returned to the sieving stage in a continuous operation.

The following examples will illustrate the invention.

EXAMPLE 1

A steel conditioning drum was provided having a length of 38 inches and diameter of 18 inches. The rear end of the drum contained a hopper for accepting oil sand and water and 30 percent of its side wall was perforated with 3/16 inch diameter openings on 5/6 inch centers. The drum was mounted on casters while a belt on the drum circumference attached to a motor driven pulley provided the rotating power. The front end of the drum was provided with a 2½ inch high washer. The drum was rotated a 1 rpm. An average of 200 pounds per hour of oil sand, analyzing 15.6% bitumen, 1.8% water and 82.6% solids, were fed to the conditioning drum for a period of four hours and were mixed therein with 40 pounds per hour of 60° F. water and 15 pounds of 5 psi steam. The product slurry passing through the perforated section of the drum analyzed 13.7% bitumen, 23.8% water and 62.5% solids, had a temperature of 140° F. and a pH of 7.0. Ten pounds per hour of reject oversize material was removed from the washer opening.

The product slurry was conveyed into the rear end of a perforated steel separation drum having a diameter of 18 inches, and a length of 12 inches. The perforations had a diameter of ¼ inch and were spaced on ⅜ inch centers to give an open area of about 40 percent. The separation drum, which rotated, at 2 rpm was supported by a pair of driven neoprene rollers. Rotation of the drum was caused by the driven collecting rollers, resting on the drum outside. The drum was coated throughout with a thin layer of vulcanized neoprene. The separation drum was positioned in a bath tank having a capacity of thirty gallons. The bath tank was supplied with 130° F. water and filled the drum up past its center line. Sand was removed at a rate of 188 pounds per hour from the bath tank with an auger.

Two rotatable neoprene collection rollers (one roller not shown) having a diameter of six inches pressed against the outside surface of the drum at a position such that the mounds illustrated in FIG. 6 were produced through the perforation. The oil was scraped from the collector rollers by doctor blades and recovered in troughs.

A perforated air hose mounted under the drum aerated the sand passing through the perforations to recovery some of the residual bitumen carried through the perforations with the sand. A paddle with an oleophilic surface was used in other tests to stir up the sand falling through the apertures.

The temperatures of the slurry within the separation drum stabilized at about 130° F. Following are the results of the run:

Bitumen product:
- 8.2% solids
- 19.8% water
- 72.0% bitumen

Sand tailings product:
- 80.4% solids
- 19.3% water
- 0.3% bitumen

Bitumen recovery at equilibrium conditions:
- Over 90%.

While the expression "diameter" has been used herein in describing the size of the perforations or apertures, it is not to be limited to circular perforations. The word "diameter" is intended to cover the average dimensions of the apertures through which the minerals pass, which can be perforations or apertures such as in a mesh sieve.

EXAMPLE 2

The same apparatus and procedure of Example 1 is used to separate low grade oil sand. An average of 200 pounds per hour of oil sand, analyzing 6.8% bitumen, 3.1% water and 90.1% solids, are fed to the conditioning drum for a period of one hour and are mixed therein with 50 pounds per hour of 60° F. water and 17 pounds of 5 psi steam.

The temperature of the slurry within the separation drum stabilizes at about 130° F. The following are the results of the run:

Bitumen product:
- 18.7% solids
- 18.3% water
- 63.0% bitumen

Sand tailings product:
- 78.3% solids
- 20.3% water
- 1.4% bitumen

EXAMPLE 3

The steel conditioning drum of Example 1 provided a product slurry passing through the perforated section of the drum that analyzed 13.7% bitumen, 23.8% water and 62.5% solids at a temperature of 140° F. and a pH of 7.0. The product slurry was conveyed to the top flight of the immersed portion of a belt separator similar to the illustration in FIG. 2. An endless belt of mesh construction was used for the separation. It was woven from high temperature and high tensile strength nylon, coated with neoprene and then vulcanized. The belt was 0.10 inches thick with an open area of 60% and with apertures that were rectangular in size 0.25 inches in the direction of belt movement and 0.125 inches across the belt (average). Screen 7 of FIG. 2 was not used and additional baffles were provided along the sides of the belt to contain the slurry and prevent it from falling past the belt. The slurry dropped onto the top flight through falling through the water and diluting with the water prior to contacting the belt. Solid particles of the slurry passed through the apertures of the top flight fell through the water and then passed through the apertures of the bottom flight. Most of the bitumen of the slurry adhered to the oleophilic top flight and a smaller amount of bitumen adhered to the bottom flight. The bottom (left) conveyor end-roll was driven with a hydraulic motor to provide clockwise rotation to give the endless belt a surface speed of 0.4 ft./sec. Slurry solids were removed from the bottom of the water bath and discarded. Bitumen was collected from the belt surface by the use of a driven recovery roller mounted in such a way that its surface touched the belt surface about one half inch before the surface of the right (top) conveyor endroll touched the belt. This position of the recovery roller provided the means whereby the conveyor endroll acted as a transfer roller to transfer the bitumen from the belt onto the recovery roller. From there it was removed with a scraper and taken away by a small conveyor. The optimum offset distance between the recovery roller and the transfer roller was obtained by adjusting the recovery roller up or down until optimum bitumen removal from the belt was achieved. Adjusting the recovery roller downward increased the belt tension and curved the belt further around the top portion of the transfer roller to bring the surfaces of the rollers closer together and decrease the offset distance. Adjusting the recovery roller upwards relieves the tension of the belt and increases the offset distance.

The bath tank was initially supplied with 130° F. water so as to cover the top belt flight past its mid point. As the test progressed, however, water needed to be withdrawn from the bath to maintain this level. Sand was removed at a rate of 188 pounds per hour from the bath tank with an auger. The temperature of the slurry and the water of the bath stabilized at about 125° F. Following are the results of the run:

Bitumen product:
- 9.2% solids
- 15.1% water
- 75.7% bitumen

Sand tailings product:
- 82.7% solids
- 17.2% water
- 0.3% bitumen

The above is illustrative of the invention and is not intended to be a limitation thereof. The invention is limited only by the appended claims.

I claim:

1. A method for recovering bitumen from oil sand comprising:

(a) providing an oil sand slurry in which bitumen and solids are dispersed in water with the bitumen having a viscosity of between about 0.1 and 10,000 poises, (b) temporarily supporting the slurry with an apertured barrier having an oleophilic surface, said barrier being partly immersed in a heated water bath to permit a separation of slurry solids from bitumen, the solids dropping through the apertures while the bitumen adheres to and coats the oleophilic surface of the barrier and the walls of apertures within the barrier, (c) forcing the bitumen adhering to the oleophilic barrier surface through the apertures with a transfer roller after the barrier has been removed from the bath; and (d) recovering the bitumen from the surface of the barrier to which it has been transferred and out of the apertures, while it is out of the bath.

2. The method as set forth in claim 1 wherein the pH of said slurry and of said bath does not exceed 8.0 during the separation.

3. The method as set forth in claim 1 wherein the temperature of the slurry undergoing separation is within the range 32°–212° F.

4. The method as set forth in claim 3 wherein the apertures in the supporting barrier have an average dimension within the range 0.05 to 0.5 inches and the thickness of the supporting barrier does not exceed three mean aperture dimensions.

5. The method as set forth in claim 1 wherein the slurry undergoing separation contains at least one half pound of water per pound of oil sand feed.

6. The method as set forth in claim 4 wherein the transfer roller has an oleophilic surface.

7. The method as set forth in claim 6 wherein bitumen is also recovered from the surface of the transfer roller.

8. The method as set forth in claim 4 comprising:

(a) recovering the bitumen from the apertured barrier with an oleophilic collecting roller which contacts the surface of said barrier; and (b) scraping the bitumen from the collecting roller for further treatment;

(c) said transfer and collecting rollers being positioned so that there is a small positive distance of offset between the centers of the rollers relative to each other in the direction of movement of the apertured barrier such that mounds of bitumen are produced on the collecting roller.

9. A method according to claim 4 wherein the apertured barrier is a rotating drum.

10. A method according to claim 4 wherein the apertured barrier is a perforated conveyor belt.

11. A method according to claim 4 wherein the apertured barrier is a mesh conveyor belt.

12. A method according to claim 4 wherein said oil sand consists of a mined oil sand.

13. The method according to claim 12 wherein the temperature of the slurry undergoing separation is within the range of 85° to 140° F.

14. The method according to claim 12 wherein the temperature of the slurry undergoing separation is within the range of 141° to 212° F.

15. A method for recovering bitumen from oil sand, which comprises;

(a) mixing oil sand with water and steam in a rotating conditioning drum to form a slurry and dispersing the oil sand components by a combination of heating and dilution with water wherein the bitumen has a viscosity between about 0.1 and 10,000 poises;

(b) transferring the slurry from the conditioning drum to a rotating apertured separation drum having oleophilic surfaces said separation drum being partly immersed in a heated water bath;

(c) temporarily supporting the slurry within the separation drum, whereby oil sand solids drop through the apertures and the bitumen moves to the inner oleophilic surface and to the walls of the apertures of the separation drum and adheres thereto;

(d) forcing bitumen adhering to the oleophilic inner surface of the separation drum through the apertures with a transfer roller after the oleophilic surface has been rotated from the bath; and (e) recovering the bitumen from the outside surface of the separation drum and out of the apertures, while it is out of the bath.

16. The method as set forth in claim 15 wherein the pH of said slurry and of said bath does not exceed 8.0 during the separation.

17. The method as set forth in claim 15 wherein:

(a) the temperature of the slurry undergoing separation is within the range of 32°–212° F.

18. The method as set forth in claim 17 wherein the apertures in the supporting wall of the separation drum have an average dimension within the range 0.05 to 0.50 inches and the thickness of the separation drum walls does not exceed three mean aperture dimensions.

19. The method as set forth in claim 18 wherein the slurry undergoing separation contains at least one half pound of water per pound of oil sand feed.

20. The method as set forth in claim 18 comprising:

(a) recovering the bitumen from the outside surface of the separation drum with an oleophilic collecting roller which contacts said surface; and (b) scraping the bitumen from the collecting roller for further treatment;

(c) said transfer and collecting rollers being positioned so that there is a small positive angle of offset between the centers of the rollers relative to the center of the separation drum such that mounds of bitumen are produced on the collecting roller.

21. The method as set forth in claim 20 wherein the oil sand consists of a mined oil sand.

22. The method according to claim 21 wherein the temperature of the slurry undergoing separation is within the range of 85° to 140° F.

23. The method according to claim 21 wherein the temperature of the slurry undergoing separation is within the range of 141° to 212° F.

24. A method for recovering bitumen from oil sand, which comprises:

(a) mixing oil sand with water and steam in a rotating conditioning drum to form a slurry and dispersing the oil sand components by a combination of steam jetting and dilution with water and tumbling wherein the bitumen has a viscosity between about 0.1 and 10,000 poises, (b) transferring the slurry from the conditioning drum to a moving apertured mesh endless separation belt having a top and a bottom flight and having oleophilic surfaces, said separation belt being partly immersed in a heated water bath;

(c) temporarily supporting the slurry with at least one flight of the endless belt, whereby oil sand solids drop through the apertures and the bitumen moves to the oleophilic surface and to the walls of the apertures of the separation belt and adheres thereto;

(d) forcing bitumen adhering to the oleophilic surface of the separation belt through the apertures with a transfer roller after the oleophilic surface has revolved out of the bath; and (e) recovering the bitumen from the surface of the endless belt to which it has been transferred and out of the apertures, while it is out of the bath.

25. The method as set forth in claim 24 wherein the pH of said slurry and of said bath being such as not to exceed 8.0 during the separation.

26. The method as set forth in claim 24 wherein the temperature of the slurry undergoing separation is within the range 32°–212° F.

27. The method as set forth in claim 26 wherein the apertures in the endless belt have an average dimension within the range 0.05 to 0.5 inches and the thickness of the belt does not exceed three mean aperture dimensions.

28. The method as set forth in claim 27 wherein the slurry undergoing separation contains at least one half pound of water per pound of oil sand feed.

29. The method as set forth in claim 27 wherein the transfer roller has an oleophilic surface.

30. The method as set forth in claim 27 wherein the endless belt has a first and second flight and wherein the oil sand passing through the apertures in the first flight of the endless belt are supported with the second flight of the endless belt, whereby oil sand solids drop through the apertures in the second flight and the bitumen moves to the oleophilic surface and to the walls of the apertures of the separation belt and adheres thereto for subsequent removal after said belt surface has moved out of the water bath.

31. The method set forth in claim 30 wherein the first flight of the endless belt is the top flight and the second flight is the bottom flight.

32. The method as set forth in claim 31 comprising:

(a) recovering the bitumen from the apertured endless belt with an oleophilic collecting roller which contacts the surface of said belt; and (b) scraping the bitumen from the collecting roller for further treatment;

(c) said transfer and collecting rollers being positioned so that there is a small positive distance of offset between the centers of the rollers relative to each other in the direction of movement of the endless belt such that mounds of bitumen are produced on the collecting roller.

33. A method according to claim 32 wherein the oil sand is a mined oil sand.

34. A method according to claim 33 wherein the temperature of the slurry undergoing separation is within the range of 85°–140° F.

35. A method according to claim 33 wherein the temperature of the slurry undergoing separation is within the range of 141°–212° F.

* * * * *